US012264546B2

(12) United States Patent
Costa de Oliveira et al.

(10) Patent No.: US 12,264,546 B2
(45) Date of Patent: Apr. 1, 2025

(54) WELLBORE PROPERTIES MEASUREMENT AND DETERMINATION

(71) Applicant: Saudi Arabian Oil Company, Dhahran (SA)

(72) Inventors: Victor Carlos Costa de Oliveira, Dhahran (SA); Daniel Thomas Scott, Dhahran (SA); Rami F. Saleh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 414 days.

(21) Appl. No.: 17/819,882

(22) Filed: Aug. 15, 2022

(65) Prior Publication Data

US 2024/0052717 A1 Feb. 15, 2024

(51) Int. Cl.

| | |
|---|---|
| ***E21B 23/04*** | (2006.01) |
| ***E21B 23/10*** | (2006.01) |
| ***E21B 47/01*** | (2012.01) |
| ***E21B 47/017*** | (2012.01) |
| ***E21B 47/02*** | (2006.01) |
| ***E21B 47/022*** | (2012.01) |
| ***E21B 47/024*** | (2006.01) |
| ***E21B 47/06*** | (2012.01) |
| ***E21B 47/26*** | (2012.01) |
| *E21B 49/00* | (2006.01) |

(52) U.S. Cl.

CPC ..... *E21B 23/04* (2013.01); *E21B 23/10* (2013.01); *E21B 47/01* (2013.01); *E21B 47/017* (2020.05); *E21B 47/02* (2013.01); *E21B 47/022* (2013.01); *E21B 47/024* (2013.01); *E21B 47/06* (2013.01); *E21B 47/26* (2020.05); *E21B 49/00* (2013.01)

(58) Field of Classification Search

CPC . E21B 3/04; E21B 23/10; E21B 47/01; E21B 47/017; E21B 47/02; E21B 47/022; E21B 47/024; E21B 47/0626

See application file for complete search history.

(56) References Cited

U.S. PATENT DOCUMENTS

| | | | | |
|---|---|---|---|---|
| 8,047,293 | B2 * | 11/2011 | Xu | E21B 34/10 166/332.8 |
| 9,540,895 | B2 * | 1/2017 | Mackenzie | E21B 23/04 |
| 2013/0118733 | A1 * | 5/2013 | Kumar | E21B 47/26 166/254.2 |

FOREIGN PATENT DOCUMENTS

| | | |
|---|---|---|
| TW | I600586 B | 10/2017 |

* cited by examiner

*Primary Examiner* — Jill E Culler

(74) *Attorney, Agent, or Firm* — Fish & Richardson P.C.

(57) ABSTRACT

A tool includes a main body configured to be disposed within a tubular string within a wellbore, such that a location of the tool within the tubular string is changeable between a surface location and a downhole location. The tool includes one or more sensors configured to measure downhole parameters from which the physical properties of the wellbore can be determined. The tool further includes a flapper configured (a) to, in response to the position of the tool changing from the surface location to the downhole location, pivot radially from a closed position in which the flapper is aligned with the main body to an open position in which the flapper is away from the main body, and (b) to, in response to the position of the tool changing from the downhole location to the surface location, pivot radially from the open position to the closed position.

20 Claims, 3 Drawing Sheets

WELLBORE PROPERTIES MEASUREMENT AND DETERMINATION

TECHNICAL FIELD

This disclosure relates to wellbore drilling and production equipment, and in particular an apparatus system, and method for measuring wellbore path information.

BACKGROUND

During drilling of wellbores and in other well-related operations, information regarding the inclination, azimuth, depth, and other physical properties of or within a wellbore or of a portion of a wellbore can be useful for a driller or operator. Among other things, such information can assist a driller or operator in ensuring that the wellbore is being drilled, completed, or operated in accordance with intended plans and in the most efficient, safe, and productive manner.

SUMMARY

This disclosure relates to apparatus for measuring physical properties of a wellbore, and corresponding systems and methods. In some embodiments, the apparatus is a pumpable and float-retrievable tool.

Certain aspects of the subject matter herein can be implemented as a system for measuring one or more physical properties of a wellbore that includes a tool and control module. The tool includes a main body configured to be disposed within a tubular string within a wellbore at least partially filled by a wellbore fluid, wherein tool is configured such that a location of the tool within the tubular string is changeable between a surface location and a downhole location. The tool further includes one or more sensors disposed on or in the main body and configured to measure one or more downhole parameters from which, at least in part, the one or more physical properties of the wellbore can be determined, and a memory module disposed within the main body and configured to receive and store downhole parameter measurements from the one or more sensors. The tool further includes a flapper disposed on the main body and configured (a) to, in response to the position of the tool changing from the surface location to the downhole location, pivot radially with respect to a longitudinal axis of the main body from a closed position in which the flapper is aligned with the main body to an open position in which the flapper is away from the main body, and (b) to, in response to the position of the tool changing from the downhole location to the surface location, pivot radially with respect to the longitudinal axis of the main body from the open position to the closed position. The control module is disposed at or proximate the surface location and is configured to receive data from the memory module after the tool has traveled from the downhole location to the surface location.

An aspect combinable with any of the other aspects can include the following features. The control module can be configured to be wirelessly connected to the memory module.

An aspect combinable with any of the other aspects can include the following features. The tool can be configured such that the position of the tool can be changed from the surface location to the downhole location by propulsion of the tool by a flow of wellbore fluid pumped into the tubular string.

An aspect combinable with any of the other aspects can include the following features. The tool can be configured such that the position of the tool can be changed from the downhole location to the surface location by propulsion of the tool by a buoyant force exerted by the wellbore fluid.

An aspect combinable with any of the other aspects can include the following features. The tool can be less dense than the wellbore fluid.

An aspect combinable with any of the other aspects can include the following features. The tool can further include a piston disposed within the main body and mechanically coupled to the flapper, and the tool can be configured such that the flapper pivots in response to a translation of the piston due to a change in hydrostatic pressure of the wellbore fluid acting on the tool.

An aspect combinable with any of the other aspects can include the following features. The wellbore fluid can be a drilling fluid and the tubular string can be a drill string.

An aspect combinable with any of the other aspects can include the following features. The one or more physical properties can include an azimuth of the wellbore and the one or more downhole parameters can include an azimuthal orientation of the main body.

An aspect combinable with any of the other aspects can include the following features. The one or more physical properties can include an inclination of the wellbore and the one or more downhole parameters can include an inclination of the main body.

An aspect combinable with any of the other aspects can include the following features. The one or more physical properties can include a depth of the wellbore at the location of the tool and the one or more downhole parameters can include a hydrostatic pressure of the wellbore fluid acting on the tool.

An aspect combinable with any of the other aspects can include the following features. The tool can further include a battery disposed within the main body and configured to provide electrical power to the memory module.

An aspect combinable with any of the other aspects can include the following features. The tool can be spherocylindrical in shape and be configured such that the major axis of the tool is parallel to an axis of the tubular string in which the tool is disposed.

Certain aspects of the subject matter herein can be implemented as a tool for determining one or more physical properties of a wellbore. The tool can include a main body configured to be disposed within a tubular string within the wellbore, wherein the wellbore is at least partially filled by a wellbore fluid and the tool is configured such that a location of the tool within the tubular string is changeable between a surface location and a downhole location. The tool includes one or more sensors disposed on or in the main body and configured to measure one or more downhole parameters from which, at least in part, the one or more physical properties of the wellbore can be determined. The tool further includes a flapper disposed on the main body and configured (a) to, in response to the position of the tool changing from the surface location to the downhole location, pivot radially with respect to a longitudinal axis of the main body from a closed position in which the flapper is aligned with the main body to an open position in which the flapper is away from the main body, and (b) to, in response to the position of the tool changing from the downhole location to the surface location, pivot radially with respect to the longitudinal axis of the main body from the open position to the closed position.

An aspect combinable with any of the other aspects can include the following features. The tool can be configured such that the position of the tool can be changed from the surface location to the downhole location by propulsion of the tool by a flow of wellbore fluid pumped into the tubular string.

An aspect combinable with any of the other aspects can include the following features. The tool can be configured such that the position of the tool can be changed from the downhole location to the surface location by propulsion of the tool by a buoyant force exerted by the wellbore fluid.

An aspect combinable with any of the other aspects can include the following features. The tool can further include a piston disposed within the main body and mechanically coupled to the flapper, and the tool can be configured such that the flapper pivots in response to a translation of the piston due to a change in hydrostatic pressure of the wellbore fluid acting on the tool.

An aspect combinable with any of the other aspects can include the following features. The wellbore fluid can be a drilling fluid and the tubular string can be a drill string.

An aspect combinable with any of the other aspects can include the following features. The one or more physical properties can include an azimuth of the wellbore and the one or more downhole parameters can include an azimuthal orientation of the main body.

An aspect combinable with any of the other aspects can include the following features. The one or more physical properties can include an inclination of the wellbore and the one or more downhole parameters can include an inclination of the main body.

Certain aspects of the subject matter herein can be implemented as a method for determining a physical property of a wellbore at least partially filled with a wellbore fluid. The method includes disposing a tool within a tubular string within the wellbore at a surface location. The tool includes a main body, one or more sensors disposed on or in the main body and configured to measure one or more downhole parameters from which, at least in part, the one or more physical properties of the wellbore can be determined, a memory module disposed within the main body and configured to receive and store downhole parameter measurements from the one or more sensors, and a flapper disposed on the main body. The method further includes flowing the wellbore fluid through the tubular string in a downhole direction, thereby propelling the tool from the surface location to the downhole location, such that the flapper, in response to an increase in hydrostatic pressure of the wellbore fluid acting on the tool as the tool travels from the surface location to the downhole location, pivots radially with respect to a longitudinal axis of the main body from a closed position in which the flapper is aligned with the main body to an open position in which the flapper is away from the main body. The method further includes reducing a flow rate of the wellbore fluid, such that a buoyant force exerted by the wellbore fluid propels the tool from the downhole location to the surface location and such that the flapper, in response to a decrease in hydrostatic pressure of the wellbore fluid as the tool travels from the downhole location to the surface location, pivots from the open position to the closed position. The method further includes receiving, from the memory module after the tool has traveled from the downhole location to the surface location, downhole parameter measurements from the one or more sensors.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

During drilling of wellbores and in other well-related operations, information regarding the trajectory, inclination, azimuth, depth, and other physical properties of or within a wellbore or of a portion of a wellbore can be useful for a driller or operator. Among other things, such information can assist a driller or operator in ensuring that the wellbore is being drilled, completed, or operated in accordance with intended plans and in the most efficient, safe, and productive manner. In some circumstances, measurement-while-drilling (MWD) tools can be attached to the bottomhole assembly to gather such information as the drilling operation proceeds. However, such tools can be expensive and have other limitations. For example, dynamic loads such as vibration, rotation, and temperature can cause failure and reduce equipment lifetimes. Furthermore, mud-pulse telemetry to receive such measurement can require downhole power requirements (from, for example, on-board turbines) which can in turn require minimum fluid flow rates. Also, readings can be limited to the area in the immediate vicinity of the bottomhole assembly. In accordance with embodiments of the present disclosure, a system, tool, and method are disclosed which can provide a reliable, simple, and cost-effective alternative to conventional MWD tools and other methods, systems, and tools for determination of wellbore physical properties. The tool can travels in an uphole or downhole direction within a drill string or other tubular string within the wellbore, propelled in a downhole direction by fluid flow and returning in an uphole direction by buoyant force. Because the tool is not attached to the bottomhole assembly, the tubular string, or other downhole component, vibrations and other mechanical stresses on the electronics and other components of the tool can be reduced or eliminated and downtime costs can be reduced. In addition, the tool can provide sensor readings along full length of the wellbore notwithstanding the relative position of the bottomhole assembly. Furthermore, in some embodiments, one or more deployable flappers can control the speed of the tool as it travels within the tubular string, thus allowing for a greater sensor accuracy and precision and longer and/or a greater number of sensor readings, and increasing tool safety.

Figure 1:
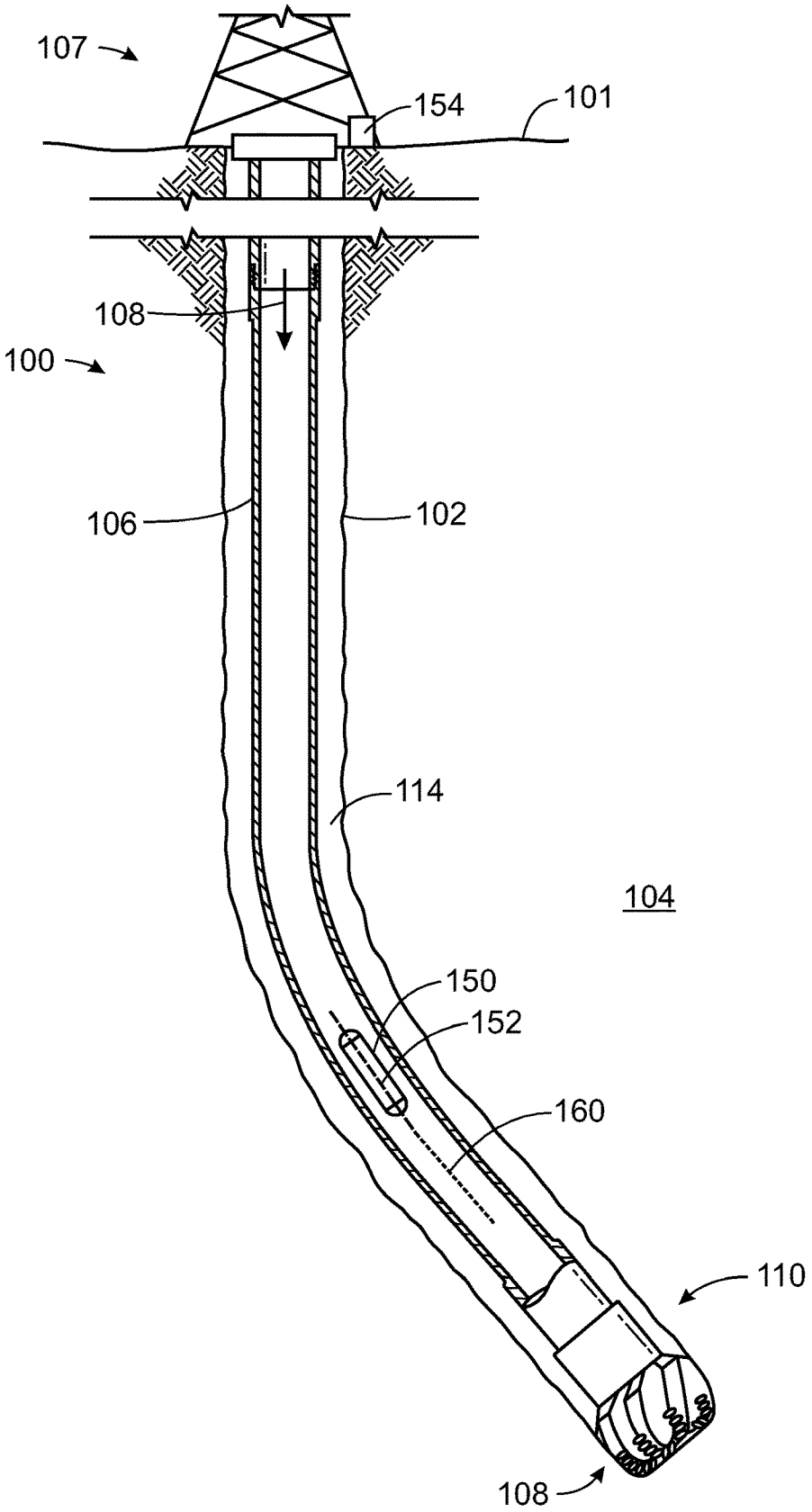
FIG. 1 is a schematic diagram of a system for measuring physical properties of a wellbore, in accordance with an embodiment of the present disclosure.

FIG. 1 is a schematic diagram of a system for measuring physical properties of a wellbore, in accordance with an embodiment of the present disclosure. Referring to FIG. 1, system 100 includes a wellbore 102 has been drilled from the surface 101 into subterranean zone 104. Tubular string 106 is disposed in wellbore 102 and is made up of a plurality of tubular segments. Wellbore fluid 108 fills (or at least partially fills) the central bore of tubular string 106.

In the illustrated embodiment, tubular string 106 is a drill string and wellbore 102 is being drilled by a drill bit 110 at a downhole end of a bottomhole assembly 112 which is coupled to the downhole end of tubular string 106. Tubular string 106 is in turn hung from drill rig 107, which can provide support and rotation to the drill string and means for adding and assembling the segments of the string as drilling continues downhole. In operation, wellbore fluid 108 (which in the illustrated embodiment is a drilling fluid) is pumped down the tubular string 106 (by, for example, a pump at drill rig 107), exits drill bit 110, and returns in an uphole direction via annulus 114. The drilling fluid can act to cool the drill bit 110 and wash away cuttings as it exits the drill bit 110 and returns in an uphole direction via annulus 114. In other embodiments, tubular string 106 can be a workover string, completion string, production tubing string, or other suitable string of tubular segments for performing drilling, completion, workover, or other downhole operations, and wellbore fluid 108 can be a completion fluid other suitable fluid.

In accordance with embodiments of the present disclosure, system 100 includes a downhole measurement tool 150 that can be disposed by an operator within tubular string 106 (for example, at drill rig 107). Tool 150 and system 100 are configured such that the position of tool 150 is changeable within tubular string 106 between a surface location (at or near surface 101) and a downhole location closer to the downhole end of the string. For example, in some embodiments, the position change can be from pumping the tool downhole by the force of flow of pumped wellbore fluids and then allowing the tool to float back uphole to be retrieved. More specifically, in the illustrated embodiment for example, measurement tool 150 has a density that is less than the density of the wellbore fluid 108 such that, in the absence of other forces, it would float when placed within the tubular string. In some embodiments, measurement tool 150 can be constructed of a material that is less dense than the wellbore fluid, and/or can include flotation elements (such as hollow and/or foam-filled spaces) such that the tool has the desired overall buoyancy. Wellbore fluid 108 can be pumped by the operator at a sufficient flow rate to overcome this buoyant force so as to propel the tool downhole, from the surface location to a desired downhole location. If and when the operator desires for the tool to return to the surface location, the operator can reduce or eliminate the flow rate, such that the tool 150 is propelled the buoyant force exerted by the wellbore fluid 108 from the downhole location back to the surface location. In some embodiments, the drilling fluid composition can be chosen by an operator to provide the desired buoyant force to the tool, and/or the tool density can be selected for a specified fluid density. Alternatively or in addition to the force of pumping and/or the buoyant force, tool 150 can be propelled uphole or downhole by a tractor, slickline, coiled tubing, or other propulsion or conveyance mechanism.

Figure 2A:
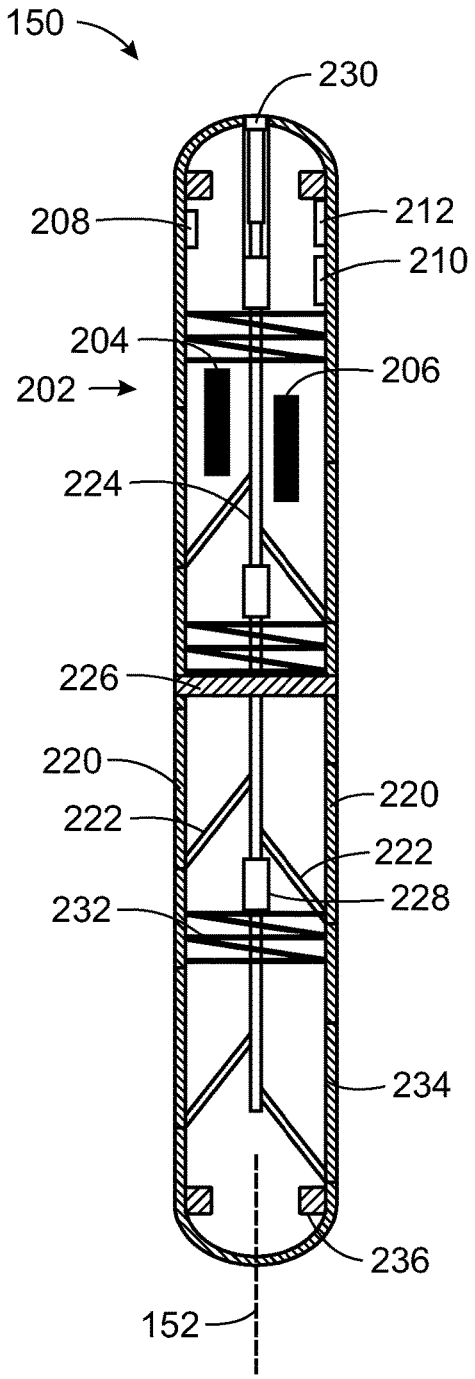
FIGS. 2A and 2B are schematic diagrams of a downhole measurement tool 150 of FIG. 1, in accordance with an embodiment of the present disclosure.
Figure 2B:
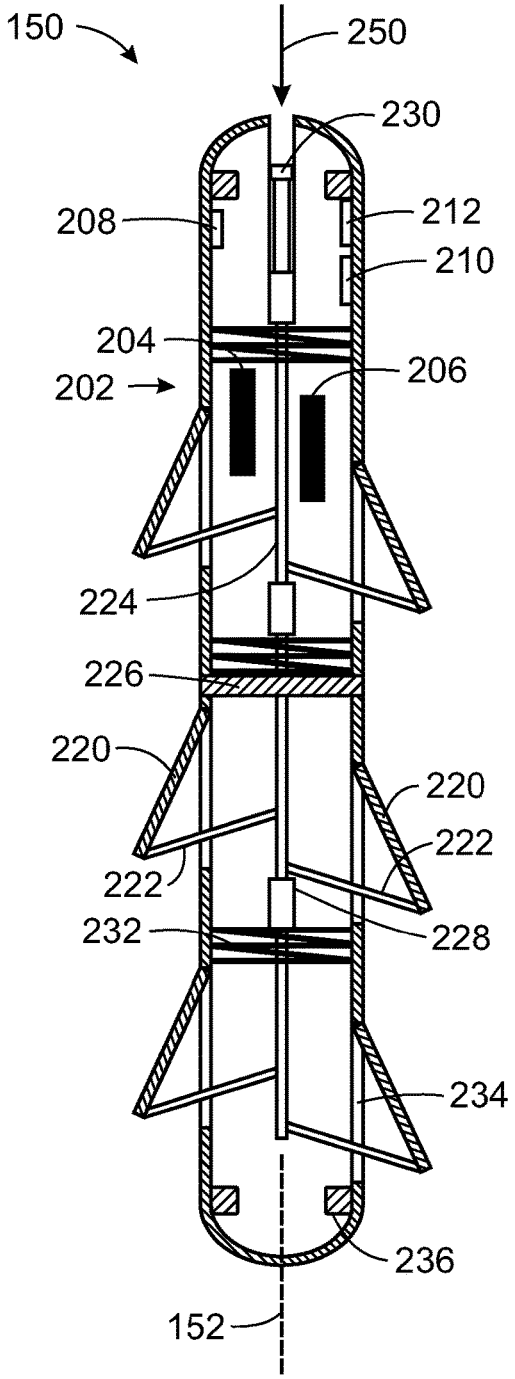

As described in greater detail in reference to FIGS. 2A and 2B, measurement tool can include one or more sensors configured to measure downhole parameters such as inclination and azimuth of the tool, the hydrostatic pressure of the wellbore fluid 108 acting on the exterior of the tool, and temperature. Such sensors can include, for example, one or more magnetometers, accelerometers, and/or other suitable sensors. From these measurements, physical properties of wellbore 102 at the downhole location where the tool is located at the time of measurement can be determined. For example, in the illustrated embodiment, tool 150 has a sphero-cylindrical or other elongated shape and has a length along its major axis 152 that is greater than the inner diameter of the central bore of tubular string 106 such that, upon placement of the tool within the tubular string, the tool orients itself with its major axis 152 parallel (or substantially parallel) to the axis 160 of the central bore of tubular string 106. Thus, the inclination and azimuth of the tool at a location within tubular string 106 is indicative of the inclination and azimuth of tubular string 106, and thus indicative of the inclination and azimuth of wellbore 102, at that location. Similarly, the hydrostatic pressure measurements can be indicative of the vertical depth of the wellbore at the location of the tool. In some instances, the physical property of the wellbore can be determined solely and directly from the downhole parameters measured by the tool. In some instances, the physical property can be inferred or otherwise determined indirectly from the sensor parameter measurements. In some instances, measurements from the sensors can be utilized in conjunction with other wellbore information (for example, from sensors on the bottomhole assembly or elsewhere in the well system) to determine a physical property of the wellbore and/or the state of the tool. In some embodiments, the depth of the tool can be determined from the number of strokes of the pump as it pumps the tool downhole, either alone or in combination with tool sensor measurements.

In some embodiments, tool 150 can include a memory module configured to receive and store the downhole parameter measurements from the sensors. The memory module can be part of an onboard memory/control module that can activate or otherwise control the sensors and other operations of the tool, and the tool can also include an onboard lithium battery or other power source (such as a small turbine) to provide electrical power to the sensors and/or the onboard memory/control module. The measurements from the sensors can be taken and recorded at one or more discrete times (for example, when the tool reaches the desired downhole location), or can be taken and recorded continuously during all or part of the travel of the tool in the uphole and/or downhole direction. Upon completion of the travel of the tool downhole and back uphole, tool 150 can be retrieved by the operator and connected (for example, by a wireless or wired connection) to a surface control module (for example, surface control module 154 of FIG. 1) at or proximate the surface location and the measurement data downloaded from the onboard memory/control module to the surface control module, for later processing as necessary and suitable utilization by the operator. In some embodiments, the onboard memory/control module includes logic which can calculate a wellbore physical property based on measured parameters. In some embodiments, a wired or wireless connection between the surface control module and the onboard memory/control module can be formed without removing tool 150 from the tubular string 106, thus enabling, for example, multiple trips downhole and back uphole without removing the tool from the tubular string.

It may be desirable in some circumstances to slow or otherwise control the speed at which tool 150 travels in an uphole or downhole direction. In some embodiments, as described in greater detail with respect to FIGS. 2A and 2B, tool 150 can include one or more flappers disposed on the main body and configured pivot radially from a first position in which the flappers are aligned with and conform to the body of the tool to a second, outwardly-protruding position such that drag on the tool is increased when in the second position as compared to the first position. In some embodiments, the tool is configured such that the movement of the flappers from the first position to the second position is in response to an increase in hydrostatic pressure acting on the tool as the tool travels in a downhole or uphole direction. In this way, the velocity of the tool as it travels in the uphole direction from the buoyant force is slowed as compared to if the flappers were not so deployed. The slowing of the tool's travel speed can enable greater sensor precision and/or accuracy, a greater number of sensor measurements, decrease the risk of damage to the tool, wellbore components, and/or rig components, and increase operational safety.

FIGS. 2A and 2B are schematic diagrams showing greater detail of downhole measurement tool 150 of FIG. 1, in accordance with an embodiment of the present disclosure. Referring to FIG. 2A, tool 150 includes a main body 202 sized and shaped (and otherwise configured) to be disposed within the tubular string. In the illustrated embodiment, tool 150 is elongate and spherocylindrical in shape and has smooth, rounded distal ends, such that the tool will orient itself with its major axis 152 parallel (or substantially parallel) to the axis of the tubular in which it is placed. In some embodiments, tool 150 can have a cylindrical, prolate spherical, or other suitable elongate shape. So configured, the tool will orient itself with its major axis 152 parallel (or substantially parallel) to the axis of the tubular in which it is place, and its location within the tubular can be readily changed (for example, between a surface location and a downhole location by propulsion of the tool in an uphole or downhole direction) as described above in reference to FIG. 1.

As described above in reference to FIG. 1, measurement tool 150 can include one or more sensors configured to measure downhole parameters such as inclination and azimuth of the tool, hydrostatic pressure, temperature, and/or other suitable parameters. In the illustrated embodiment, such sensors can include, for example, one or more magnetometers 204, accelerometers 206, and pressure sensor 208. In the illustrated embodiment, tool 150 includes a memory/control module 210 configured to receive and store the downhole parameter measurements from the sensors, and battery 212 to provide necessary power the sensors and/or memory/control module 210.

In the illustrated embodiment, tool 150 further includes one or more flappers 220 configured pivot radially with respect to central axis 152 from (a) a first, closed position (shown in FIG. 2A) in which the flappers are aligned with and conform (or substantially conform) to the outer surface of main body 202 to (b) a second, open position (shown in FIG. 2B) in which the flappers are away from main body 202 (and this within the wellbore fluid surrounding the tool) such that drag on the tool is increased (as compared to the first position) as the flappers pivot to the second position. Flappers 220 can have a shape, size, and other features that provides a desired degree of drag when partially or completely deployed. For example, each or all of flappers 220 can comprise a solid or perforated body that can be substantially planar, substantially flat or can have a curved shape that conforms the external shape of main body 202, or another suitable shape. Flappers 220 can be of any suitable thickness; for example, substantially thinner than its other dimensions (for example, a substantially disc-shaped flapper having a thickness that is substantially less than its diameter). Flappers 220 are coupled to a central mandrel 224 via arms 222, such that the above-described pivot of flappers 220 is in response to longitudinal translation of mandrel 224 along (parallel to) central axis 152, which in turn is driven by movement of a piston 230 to which mandrel 224 is coupled (for example, by a threaded coupling). The movement of piston 230 is in response to an increase in hydrostatic pressure 250 exterior of the tool acting on the piston 230 due to the depth and/or the force of the flow of fluid across the tool as it travels in an uphole or downhole direction. In addition to slowing the speed of the tool, the flappers 220 when partially or completely deployed can act to stabilize and maintain the tool's desired orientation within the tubular string.

In the illustrated embodiment, one or more centralizers 226 minimize lateral movement of mandrel 224 as it translates along its axis. Springs 232 are coupled to stoppers 228 which are in turn coupled to mandrel 224, and are configured to urge mandrel 224 towards the first position, such that the hydrostatic pressure acting on the piston must overcome the force of springs 232 in order for flappers 220 to pivot to the second position. In some embodiments, the spring force (spring constant) of springs 232 can be selected by an operator based on a desired degree of pivot of flappers 220 in response to an expected downhole pressure gradient. In some embodiments, the spring force of the springs can be selected such that the flappers remain closed until the tool reaches (or approaches) the desired furthest downhole location, and remain at least partially open (due at least in part to the speed of the tool) as the tool travels in the uphole direction. In some embodiments, the speed of the tool as it travels in an uphole direction can compensate for a decrease in hydrostatic pressure as the tool travels uphole, thus maintaining the open deployment of the flappers.

In the illustrated embodiment, flappers 220 reside in pockets 234 when flappers 220 are in the first, closed position, thus aligning the flappers with the exterior surface of the main body 202 and minimizing drag and the risk of hang-up as the tool is initially disposed in the tubular and travels downhole from the surface location. Seals 236 can minimize the risk of leaks of wellbore fluid into tool and thus the risk of damage to the inner components of the tool.

Figure 3:
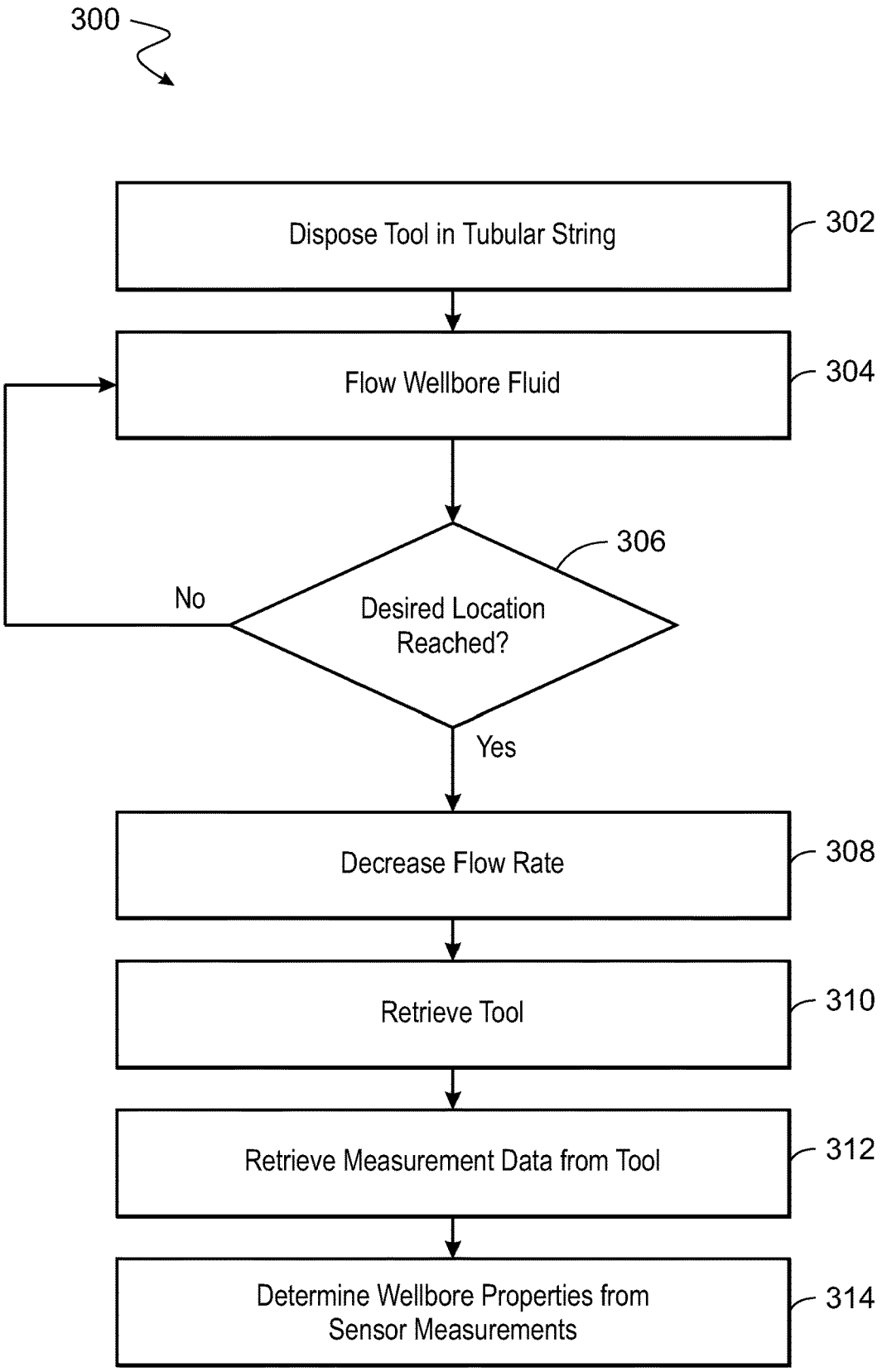
FIG. 3 is a process flow diagram of a method for determining a physical property of a wellbore at least partially filled with a wellbore fluid, in accordance with an embodiment of the present disclosure.

FIG. 3 is a process flow diagram of a method 300 for determining a physical property of a wellbore at least partially filled with a wellbore fluid, in accordance with an embodiment of the present disclosure. The method begins at step 302 wherein an operator (or other suitable entity or individual) disposes a measurement tool within a tubular string within the wellbore at a surface location. In some embodiments, the measuring tool can be the same as or similar to tool 150 of FIGS. 2A and 2B, as described above. The tool can include a main body with one or more sensors and can be configured to measure one or more downhole parameters (for example, tool azimuth and/or tool inclination) from which (at least in part) the one or more physical properties of the wellbore (such as azimuth and/or inclination of the wellbore) can be determined. The tool can in some embodiments also include a memory module configured to receive and store parameter measurements from the sensors. In some embodiments, the tool can include one or more flappers the same or similar as described above with respect to flappers 220 of tool 150.

Proceeding to step 304, the operator can initiate or increase a flow of wellbore fluid through the tubular string in a downhole direction, thereby propelling the tool from the surface location to the downhole location. In response to the gradual increase in hydrostatic pressure of the wellbore fluid acting on the tool as the tool travels from the surface location to the downhole location, the flapper or flappers gradually pivot radially with respect to a longitudinal axis of the main body from a closed position in which the flappers are aligned with the main body to an open position in which the flappers away from the main body. Proceeding to step 306, the operator can determine or conclude whether the tool has reached its desired downhole location. In some embodiments, the tool's depth can be determined based (at least in part) on the number of pump strokes that have occurred since deploying the tool within the tool string, taking into account piston size, tubular string diameter, fluid density, and other factors.

If at step 306 the operator determines or concludes that the tool has not yet reached the desired downhole location, the method returns to step 304 in which pumping continues so as to continue propelling the tool downhole. If at step 306 the operator determines or concludes that the tool has reached the desired downhole location, the method proceeds to step 308 in which the operator can reduce (or completely shut off) the fluid flow, such that a flow rate of the wellbore fluid, such that a buoyant force exerted by the wellbore fluid propels the tool from the downhole location to the surface location. In response to the gradual decrease in hydrostatic pressure of the wellbore fluid as the tool travels from the downhole location to the surface location, the flapper gradually pivots from the open position to the closed position.

At step 310 the operator can retrieve the tool, for example by removing the tool from the tubular string when the tool reaches the surface. At step 312, measurement data can be downloaded or otherwise retrieved by the from the memory module by, for example, connecting (with a wired or wireless connection) the memory module with a surface control module. In some embodiments, the data can be retrieved without removing the tool from the tubular string (for example, by a wireless connection across a wall of the tubular string). Proceeding to step 314, one or more wellbore properties (such as wellbore azimuth or inclination) can be determined based at least in part on the retrieved data from the tool.

The term "uphole" as used herein means in the direction along the production tubing or the wellbore from its distal end towards the surface, and "downhole" as used herein means the direction along a tubing string or the wellbore from the surface towards its distal end. A downhole location means a location along the tubing string or wellbore downhole of the surface. "Approximately" or "substantially" as used herein means a deviation or allowance of up to 10 percent (%). Likewise, "about" can also allow for a degree of variability in a value or range, for example, within 10%, within 5%, or within 1% of a stated value or of a stated limit of a range.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A system for measuring one or more physical properties of a wellbore, the system comprising:

a tool comprising:

a main body configured to be disposed within a tubular string within a wellbore at least partially filled by a wellbore fluid, wherein tool is configured such that a location of the tool within the tubular string is changeable between a surface location and a downhole location;

one or more sensors disposed on or in the main body and configured to measure one or more downhole parameters from which, at least in part, the one or more physical properties of the wellbore can be determined;

a memory module disposed within the main body and configured to receive and store downhole parameter measurements from the one or more sensors; and a flapper disposed on the main body and configured (a) to, in response to the position of the tool changing from the surface location to the downhole location, pivot radially with respect to a longitudinal axis of the main body from a closed position in which the flapper is aligned with the main body to an open position in which the flapper is away from the main body, and (b) to, in response to the position of the tool changing from the downhole location to the surface location, pivot radially with respect to the longitudinal axis of the main body from the open position to the closed position; and a control module disposed at or proximate the surface location and configured to receive data from the memory module after the tool has traveled from the downhole location to the surface location.

2. The system of claim 1, wherein the control module is configured to be wirelessly connected to the memory module.

3. The system of claim 1, wherein the tool is configured such that the position of the tool can be changed from the surface location to the downhole location by propulsion of the tool by a flow of wellbore fluid pumped into the tubular string.

4. The system of claim 1, wherein the tool is configured such that the position of the tool can be changed from the downhole location to the surface location by propulsion of the tool by a buoyant force exerted by the wellbore fluid.

5. The system of claim 1, wherein the tool is less dense than the wellbore fluid.

6. The system of claim 1, wherein the tool further comprises a piston disposed within the main body and mechanically coupled to the flapper, and wherein the tool is configured such that the flapper pivots in response to a translation of the piston due to a change in hydrostatic pressure of the wellbore fluid acting on the tool.

7. The system of claim 1, wherein the wellbore fluid comprises a drilling fluid and the tubular string comprises a drill string.

8. The system of claim 1, wherein the one or more physical properties comprises an azimuth of the wellbore and wherein the one or more downhole parameters comprises an azimuthal orientation of the main body.

9. The system of claim 1, wherein the one or more physical properties comprises an inclination of the wellbore and wherein the one or more downhole parameters comprises an inclination of the main body.

10. The system of claim 1, wherein the one or more physical properties comprises a depth of the wellbore at the location of the tool and wherein the one or more downhole parameters comprises a hydrostatic pressure of the wellbore fluid acting on the tool.

11. The system of claim 1, wherein the tool further comprises a battery disposed within the main body and configured to provide electrical power to the memory module.

12. The system of claim 1, wherein the tool is spherocylindrical in shape and is configured such that the major axis of the tool is parallel to an axis of the tubular string in which the tool is disposed.

13. A tool for determining one or more physical properties of a wellbore, comprising:

a main body configured to be disposed within a tubular string within the wellbore, wherein the wellbore is at least partially filled by a wellbore fluid and the tool is configured such that a location of the tool within the tubular string is changeable between a surface location and a downhole location;

one or more sensors disposed on or in the main body and configured to measure one or more downhole parameters from which, at least in part, the one or more physical properties of the wellbore can be determined; and a flapper disposed on the main body and configured (a) to, in response to the position of the tool changing from the surface location to the downhole location, pivot radially with respect to a longitudinal axis of the main body from a closed position in which the flapper is aligned with the main body to an open position in which the flapper is away from the main body, and (b) to, in response to the position of the tool changing from the downhole location to the surface location, pivot radially with respect to the longitudinal axis of the main body from the open position to the closed position.

14. The tool of claim 13, wherein the tool is configured such that the position of the tool can be changed from the surface location to the downhole location by propulsion of the tool by a flow of wellbore fluid pumped into the tubular string.

15. The tool of claim 13, wherein the tool is configured such that the position of the tool can be changed from the downhole location to the surface location by propulsion of the tool by a buoyant force exerted by the wellbore fluid.

16. The tool of claim 13, wherein the tool further comprises a piston disposed within the main body and mechanically coupled to the flapper, and wherein the tool is configured such that the flapper pivots in response to a translation of the piston due to a change in hydrostatic pressure of the wellbore fluid acting on the tool.

17. The tool of claim 13, wherein the wellbore fluid comprises a drilling fluid and the tubular string comprises a drill string.

18. The tool of claim 13, wherein the one or more physical properties comprises an azimuth of the wellbore and wherein the one or more downhole parameters comprises an azimuthal orientation of the main body.

19. The tool of claim 13, wherein the one or more physical properties comprises an inclination of the wellbore and wherein the one or more downhole parameters comprises an inclination of the main body.

20. A method for determining a physical property of a wellbore at least partially filled with a wellbore fluid, the method comprising:

disposing a tool within a tubular string within the wellbore at a surface location, the tool comprising:

a main body;

one or more sensors disposed on or in the main body and configured to measure one or more downhole parameters from which, at least in part, the one or more physical properties of the wellbore can be determined;

a memory module disposed within the main body and configured to receive and store downhole parameter measurements from the one or more sensors; and a flapper disposed on the main body;

flowing the wellbore fluid through the tubular string in a downhole direction, thereby propelling the tool from the surface location to the downhole location, such that the flapper, in response to an increase in hydrostatic pressure of the wellbore fluid acting on the tool as the tool travels from the surface location to the downhole location, pivots radially with respect to a longitudinal axis of the main body from a closed position in which the flapper is aligned with the main body to an open position in which the flapper is away from the main body;

reducing a flow rate of the wellbore fluid, such that a buoyant force exerted by the wellbore fluid propels the tool from the downhole location to the surface location and such that the flapper, in response to a decrease in hydrostatic pressure of the wellbore fluid as the tool travels from the downhole location to the surface location, pivots from the open position to the closed position; and receiving, from the memory module after the tool has traveled from the downhole location to the surface location, downhole parameter measurements from the one or more sensors.

* * * * *